US009695547B2

(12) United States Patent
Bison et al.

(10) Patent No.: US 9,695,547 B2
(45) Date of Patent: Jul. 4, 2017

(54) METHOD FOR OPERATING A TUMBLE DRYER

(75) Inventors: Alberto Bison, Pordenone (IT); Francesco Cavarretta, Pordenone (IT); Maurizio Ugel, Fiume Veneto (IT)

(73) Assignee: Electrolux Home Products Corporation N.V., Brussels (BE)

( * ) Notice: Subject to any disclaimer, the term of this patent is extended or adjusted under 35 U.S.C. 154(b) by 381 days.

(21) Appl. No.: 14/128,878

(22) PCT Filed: Jun. 26, 2012

(86) PCT No.: PCT/EP2012/062346

§ 371 (c)(1),
(2), (4) Date: Apr. 24, 2014

(87) PCT Pub. No.: WO2013/000904

PCT Pub. Date: Jan. 3, 2013

(65) Prior Publication Data

US 2014/0373386 A1 Dec. 25, 2014

(30) Foreign Application Priority Data

Jun. 29, 2011 (EP) ..... 11171948

(51) Int. Cl.
*D06F 58/28* (2006.01)

(52) U.S. Cl.
CPC ..... *D06F 58/28* (2013.01); *D06F 2058/288* (2013.01); *D06F 2058/2829* (2013.01); *D06F 2058/2877* (2013.01)

(58) Field of Classification Search
CPC ..... D06F 58/28; D06F 2058/2829; D06F 2058/2877; D06F 2058/288; D06F 2202/06; D06F 2202/065
See application file for complete search history.

(56) References Cited

U.S. PATENT DOCUMENTS 4,640,022 A * 2/1987 Suzuki ..... D06F 58/28 34/552
5,651,194 A 7/1997 Hayashi
2010/0024243 A1 2/2010 Ricklefs et al.

FOREIGN PATENT DOCUMENTS

DK EP 0512940 A1 * 11/1992 ..... D06F 58/28
EP 1657351 5/2006

(Continued)

OTHER PUBLICATIONS

International Search Report mailed Nov. 30, 2012 in corresponding International Application No. PCT/EP2012/062346.

(Continued)

*Primary Examiner* — Kenneth Rinehart
*Assistant Examiner* — Tavia Sullens
(74) *Attorney, Agent, or Firm* — Banner & Witcoff, LTD.

(57) ABSTRACT

A method is provided for operating a laundry dryer having a rotatable drum for accommodating clothes to be dried and an apparatus for circulating drying air through the drum. The method comprises the steps of performing a drying cycle selected by a user, wherein the drying cycle comprises predetermined drum movements over time depending on the cycle selected, detecting values indicative of the temperature of the drying air exiting the drum, based on said detected values, determining that the clothes inside the drum are in tangling conditions and starting an untangling operation for untying the clothes inside the drum. The untangling operation comprises modification of the predetermined drum movements. The modification comprises at least one of the following: stopping the rotation of the drum, reversing the rotation of the drum, modifying the speed of rotation of the drum, at the end of the untangling operation, either resuming the predetermined drum movements associated to the drying cycle that was running before starting the untangling operation, or performing drum movements over time different (Continued)

from the predetermined drum movements associated to the drying cycle that was running before starting the untangling operation.

10 Claims, 8 Drawing Sheets

(56) References Cited

FOREIGN PATENT DOCUMENTS

| | | |
|---|---|---|
| GB | 2265700 | 10/1993 |
| GB | 2288867 | 11/1995 |

OTHER PUBLICATIONS

Extended European Search Report dated Jan. 17, 2012 in corresponding European Application No. 11171948.0.

* cited by examiner

METHOD FOR OPERATING A TUMBLE DRYER

FIELD OF TECHNOLOGY

The present disclosure relates to drying machines (e.g. Tumble Dryer) or washing/drying machines with a rotating drum, more particularly to a method and system for operating a laundry machine.

BACKGROUND

In drying machines with a rotating drum (e.g. Tumble Dryers) a flow rate of hot air passes through the drum, removing water from wet clothes. Inside the drum, the hot air is cooled down and the heat released by the air allows the evaporation of the water from the clothes. Vented Tumble Dryers suck the ambient air, heat it up by means of an electrical heater and discharge it after flowing in the drum. In condense Tumble Dryers and in heat pump Tumble Dryers, instead, the process air flows in a closed loop: the air is heated up by an electric heater or by the condenser of the heat pump unit before entering the drum and then the air is cooled and dehumidified by an air to air exchanger or by the evaporator of the heat pump unit at drum outlet.

In any case the drying capacity of the process air strictly depends on the heat exchange between the hot air and the wet clothes and can be dramatically affected if occasionally the clothes get wrapped together in one or more knots: in such an event, the inlet hot air cannot remove water efficiently, thus compromising the overall performance of the machine.

In order to prevent the constitution of clothes-knots during the drying cycle, many Tumble Dryers implement special procedures which are launched at fixed time intervals during the cycle, with the purpose to untie possible clothes-knots. As an example, the Tumble Dryer may stop and start the drum rotation or in some cases it can even reverse the drum rotation. It's important to highlight that in any case such procedures introduce specific inefficiencies because they may affect the cycle duration and the drying efficiency (for example if the rotation is stopped for a while the load in the drum cools down and it is necessary to spend energy to warm it up again).

Anyhow, such procedures have several disadvantages, e.g. they are launched at fixed time interval, also when not necessary; therefore they can eventually decrease the overall Tumble Dryer efficiency (cycle time, drying efficiency). Another possible disadvantage can occur in case a clothes-knot is made between one procedure and the next one, the inefficiency introduced by the knot, in this case, would last until the following untangling procedure is started. Furthermore, with prior art systems, even in presence of a clothes-knot, it is not possible to understand if the procedure has been successful or not in unwrapping the knot. It is to be appreciated that the terms "untangling" and "untying" are used interchangeably herein, as are the terms "untangle" and "untie", and "untangled" and "untied".

Further, since such untangling procedures are launched in any case, even when there is no need for them, another disadvantage is connected with the electric motor wear due to the many re-starting of the motor.

Additionally, since the untangling procedures are launched at fixed time interval (without being effective and thereby resolving the laundry tangling), uneven dryness of the laundry can still occur.

In most of condensate dryers (with air/air heat exchanger), only one motor drives the process fan and drum and the process fan normally is designed so that its efficiency is high in a process rotation direction, whereas the efficiency is low in a reverse rotation direction and during the untangling procedures the drum and hence the process fan is driven into reverse rotation direction. As a consequence the drying air flow rate is extremely low during the untangling procedures so that the time needed to dry the laundry tends to increase. Please note that during the untangling procedures the electric heater is switched OFF.

As mentioned above, it is known in commercially available systems to perform untangling operations in order to reduce or eliminate the tangling of clothes. One of the problems of such methods is that of establishing the right moment for starting the untangling operations. E.g. U.S. Pat. No. 5,651,194 discloses a method and system for controlling a dryer for drying items in a rotating drum by supplying hot air. The method and system disclosed in U.S. Pat. No. 5,651,194 includes an untangling operation which is launched when a predetermined degree of dryness is reached. The dryness is measured by means of dryness sensors which include electrodes positioned inside the drum so that the items to be dried come into contact with the electrode while the drum is rotating: the degree of dryness is estimated according to the current passing through the electrodes.

The technique discussed in U.S. Pat. No. 5,651,194 does not however address the problem of detecting the clothes tangles. The untangling operation is started anyway when an estimated dryness degree is reached, irrespective of the effective presence of clothes tangling.

OBJECTS OF THE DISCLOSURE

It is an object of the present disclosure to overcome at least some of the problems associated with the prior art.

SUMMARY

The present disclosure provides a method and system as set out in the accompanying claims.

According to one aspect of the present disclosure there is provided a method for operating a laundry dryer having a rotatable drum for accommodating clothes to be dried and an apparatus for circulating drying air through the drum, the method comprises the steps of performing a drying cycle selected by a user, wherein the drying cycle comprises predetermined drum movements over time depending on the cycle selected, detecting values indicative of the temperature of the drying air exiting the drum, based on said detected values, determining that the clothes inside the drum are in tangling conditions and starting an untangling operation to untie the clothes inside the drum, wherein the untangling operation comprises a modification of the predetermined drum movements and the modification comprises at least one of the following: stopping the rotation of the drum, reversing the rotation of the drum, modifying the speed of rotation of the drum, at the end of the untangling operation, either resuming the predetermined drum movements associated to the drying cycle that was running before starting the untangling operation, or performing drum movements over time different from the predetermined drum movements associated to the drying cycle that was running before starting the untangling operation.

Preferably, the step of determining that the clothes inside the drum are in tangling conditions comprises comparing the detected values with the at least one reference parameter.

Preferably, clothes tangling conditions are determined when the detected values exceed a predetermined threshold.

Preferably, the step of determining that the clothes inside the drum are in tangling conditions comprises maintaining in a memory at least one reference parameter indicative of an expected behavior of temperature of the drying air exiting the drum over the time during the drying cycle.

Preferably, the reference parameter includes a maximum expected frequency value indicative of the expected frequency range of the base temperature signal of drying air exiting the drum without clothes tangling conditions, and wherein the step of determining clothes tangling conditions comprises building a curve with the detected values of temperature over time and responsive to the curve showing a frequency higher than maximum expected frequency, determining the existence of clothes tangling conditions.

Preferably, the step of determining the existence of clothes tangling conditions comprises filtering the curve with a high-pass numeric filter which cuts all frequencies lower than the maximum frequency value.

Preferably, the expected temperature over the time is adjusted according to values detected during the drying cycle.

Preferably, the step of adjusting the expected temperature is performed at the beginning of drying cycle, before the step of monitoring the detected values.

Preferably, responsive to the detected values no longer showing any clothes tangling conditions, suspending the untangling operation and resuming the predetermined drum movements associated to the drying cycle running before starting the untangling operation.

Preferably, the laundry dryer comprises sensors for detecting values indicative of the temperature of the air exiting the drum at or downstream of the outlet of the drum, preferably the sensors are arranged inside the drum and/or at the outlet of the drum and/or downstream of the outlet of the drum (considering the direction of the drying air flow) and preferably between the drum outlet and the condensing means in case of a condensation type dryer.

Preferably, the step of determining clothes tangling conditions comprises: detecting a plurality of values indicative of the temperature of clothes items; building a curve with the detected values of temperature over time; measuring the gradient of the curve at regular time intervals $t_c$; and comparing successive measured gradients for determining if the difference exceeds a predetermined threshold.

According to a further aspect of the present invention there is provided a laundry dryer including microprocessor means for implementing the above-mentioned methods.

Preferably, the laundry dryer comprises: a rotating drum; at least one sensor for detecting temperatures during the drying cycle; memory means for storing at least one reference parameter indicative of an expected behavior of temperature of the clothes over the time during the drying cycle; processor means for estimating the temperature of the clothes items according to the detected temperature and for starting an untangling operation if an anomaly of the detected values with respect to the at least one reference parameter is identified.

Preferably, operating drum movements over time different from the predetermined drum movements associated to the drying cycle that was running before starting the untangling operation includes the step of reducing the number of reversions of drum rotation and/or the time interval in which the drum rotates in reversed rotation direction and/or increasing/decreasing the drum rotation speed.

According to further aspect of the present disclosure there is provided a method, for detecting the occurrence of clothes knots during a drying cycle inside a rotating drum of a drying machine for drying clothes items, the drying machine including sensors for detecting values indicative of the temperature of clothes items, the method including the steps of: maintaining in a memory at least one reference parameter indicative of an expected behavior of temperature of the clothes over the time during the drying cycle; monitoring the detected values; responsive to an anomaly of the detected values with respect to the at least one reference parameter being detected, and starting an untangling operation.

In a further aspect of the invention the expected temperature over the time is adjusted according to values detected during the drying cycle.

In another aspect of the present invention the step of adjusting the expected temperature is performed at the beginning of drying cycle, before the step of monitoring the detected values.

In a further aspect of the invention the information on expected temperature includes a maximum expected frequency value indicative of the expected frequency range of the base temperature signal of the clothes items without the presence of clothes knots, and wherein the step of determining the existence of an anomaly includes the steps of: building a curve with the detected values of temperature over time; responsive to the curve showing a frequency higher than maximum expected frequency, determining the existence of an anomaly.

In another aspect of the invention the step of determining the existence of an anomaly includes: filtering the curve with a high-pass numeric filter which cut all frequencies lower than the maximum frequency value.

In a further aspect of the present invention the untangling operations include stopping the rotation of the drum and possibly reversing the rotation of the drum.

In yet another aspect of the present invention we provide a system which includes components adapted to implement the above methods.

A still further aspect of the present invention provides a computer program for performing the above described methods.

The method and system according to preferred embodiments of the present invention allows to launch an untangling operation only when really needed.

The present invention offers a number of benefits. One of the advantages of the method according to a preferred embodiment of the present invention is that of increasing efficiency of the drying (or washing/drying) machine by avoiding loss of energy and time.

BRIEF DESCRIPTION OF THE DRAWINGS

Reference will now be made, by way of example, to the accompanying drawings, in which.

DETAILED DESCRIPTION OF PREFERRED EMBODIMENTS

The method according to a preferred embodiment of the present invention aims at detecting the formation of clothes-knots during the drying cycle, so that the untangling operations are started only when needed. It has been discovered that, in presence of clothes-knots, the drying capacity of the air decreases dramatically: water is not removed from the clothes, so the cycle is longer and less efficient.

Figure 1:
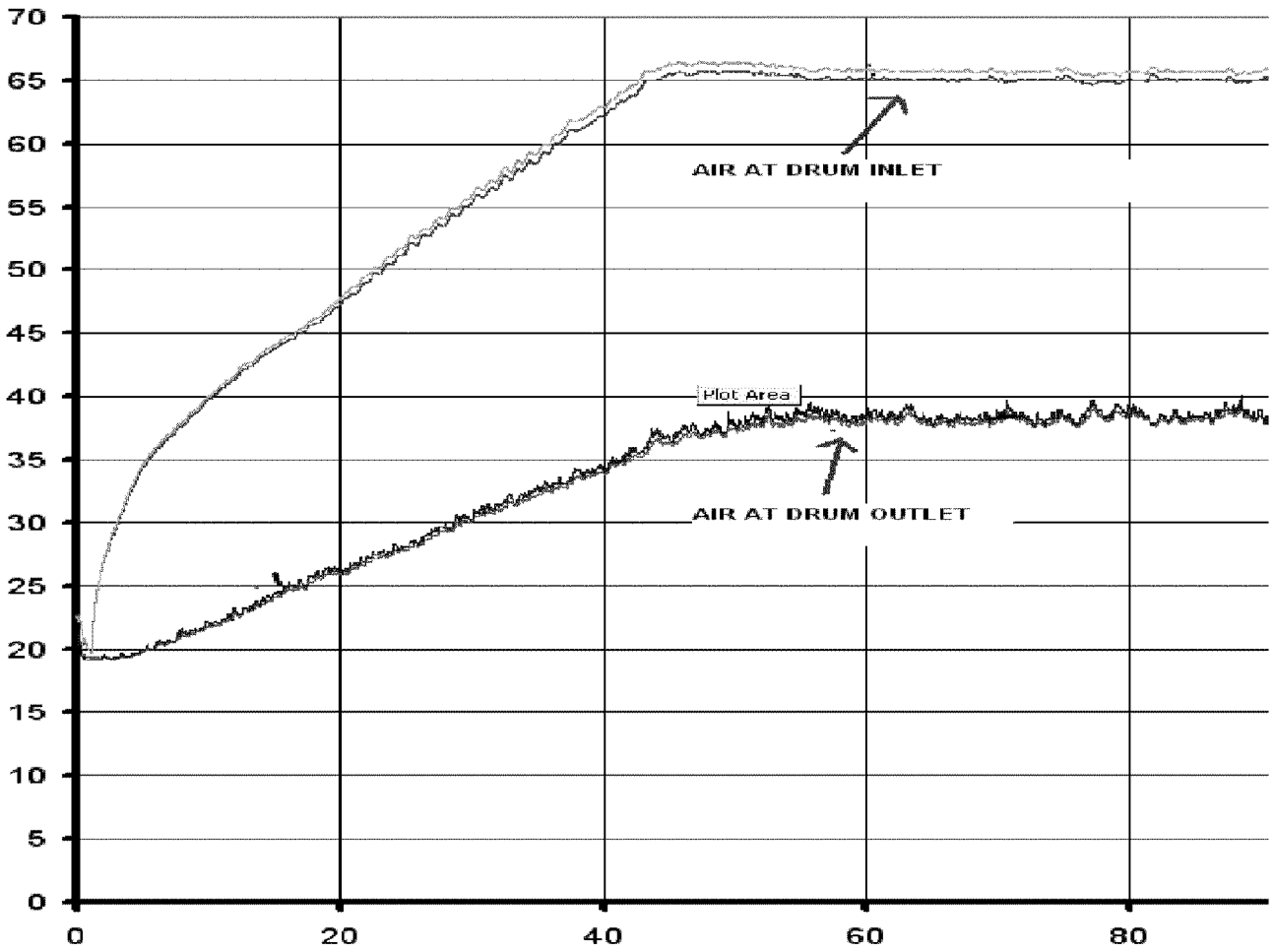
FIG. 1 is a schematic diagram of the expected temperature curves of air respectively at an inlet and at an outlet of the drum of a drying machine during drying cycle.

FIG. 1 represents a diagram showing a typical temperature of the process air at the inlet and at the outlet of the drum in a heat pump Tumble Dryer. The air temperatures increase during the transitory phase and then they are constant in the steady state phase. Almost nothing changes in case of vented or condense no-Heat Pump Tumble Dryers. The example shown is based on a medium load of the machine with clothes items having humidity close to 100%.

Figure 2:
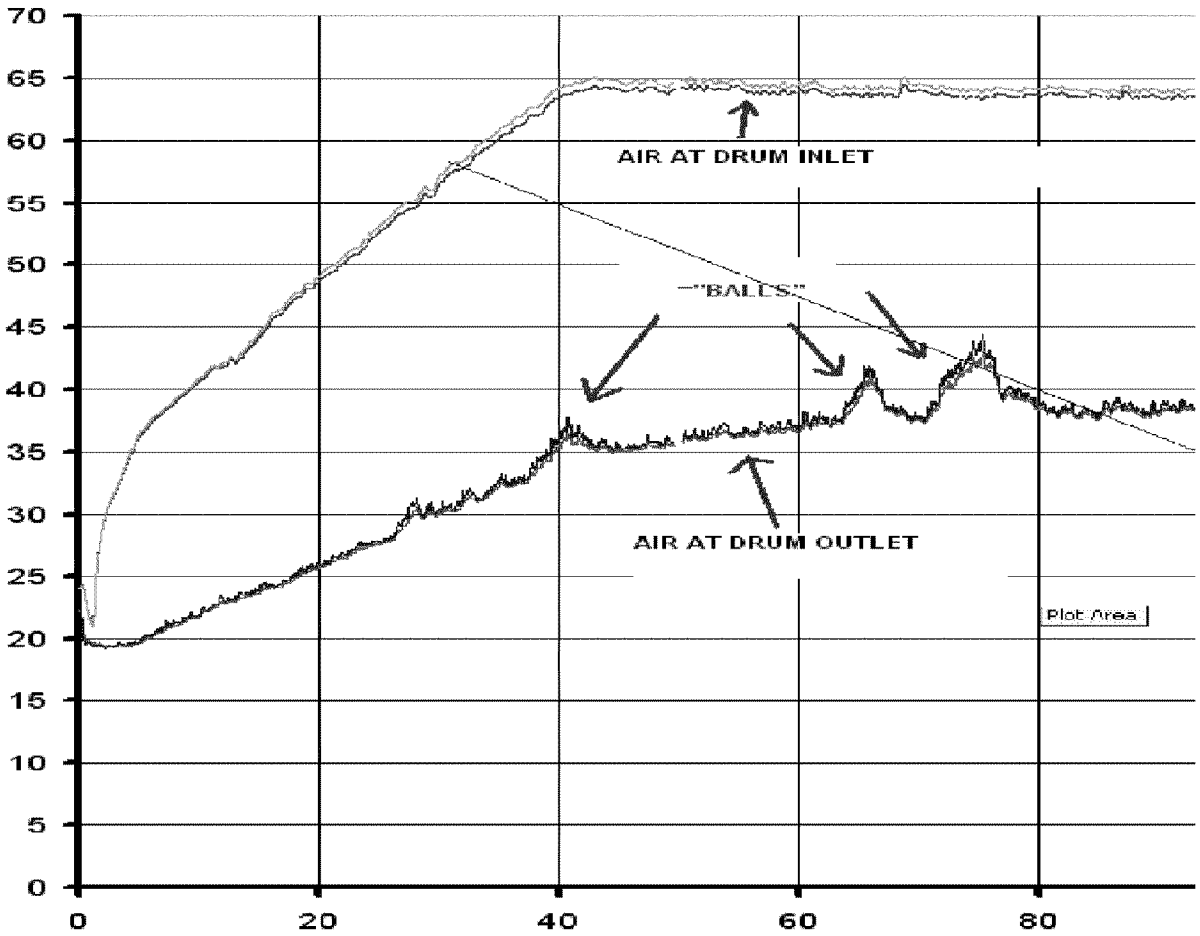
FIG. 2 represents the same temperature curves when one or more clothes knot occurs.

If one or more clothes-knots (also called "balls" ) occur, the temperature of the air at drum outlet is higher than usual, because the hot air at the drum inlet cannot efficiently exchange heat with the clothes. This event is clearly shown in FIG. 2.

According to the present invention the method for operating a laundry dryer having a rotatable drum for accommodating clothes to be dried and an apparatus for circulating drying air through the drum, comprises the steps of performing a drying cycle selected by a user, wherein the drying cycle comprises predetermined drum movements over time depending on the cycle selected, detecting values indicative of the temperature of the drying air exiting the drum, based on said detected values, determining that the clothes inside the drum are in tangling conditions and starting an untangling operation for untying the clothes inside the drum, wherein the untangling operation comprises modification of the predetermined drum movements and the modification comprises at least one of the following: stopping the rotation of the drum, reversing the rotation of the drum, modifying the speed of rotation of the drum, at the end of the untangling operation, either resuming the predetermined drum movements associated to the drying cycle that was running before starting the untangling operation, or performing drum movements over time different from the predetermined drum movements associated to the drying cycle that was running before starting the untangling operation.

In a preferred embodiment of the present invention, a temperature sensor is used to measure the temperature level of the air at the drum outlet and to compare this value with the temperature value which is expected in case that no clothes-knots are present. If the air temperature is higher than expected, a clothes-knot is present and the Tumble Dryer may start the procedures to untie the knot, e.g. the Tumble Dryer electronics may stop and start the rotation or may reverse it for a few seconds.

In this way, a good efficiency of the heat exchange air-wet clothes is assured.

It is to be noted that the temperature gradient of the outlet air depends on the amount of load and on its moisture content, therefore a fixed threshold value for the outlet air temperature could introduce some unwanted results, because in some cases the air temperature may be always higher than the threshold (small loads, low moisture content) or always lower (big loads, high moisture content). In further embodiments of the present invention it is possible to add a more sophisticated calculation in order to overcome this limitation and to avoid such unwanted situations.

Figure 3:
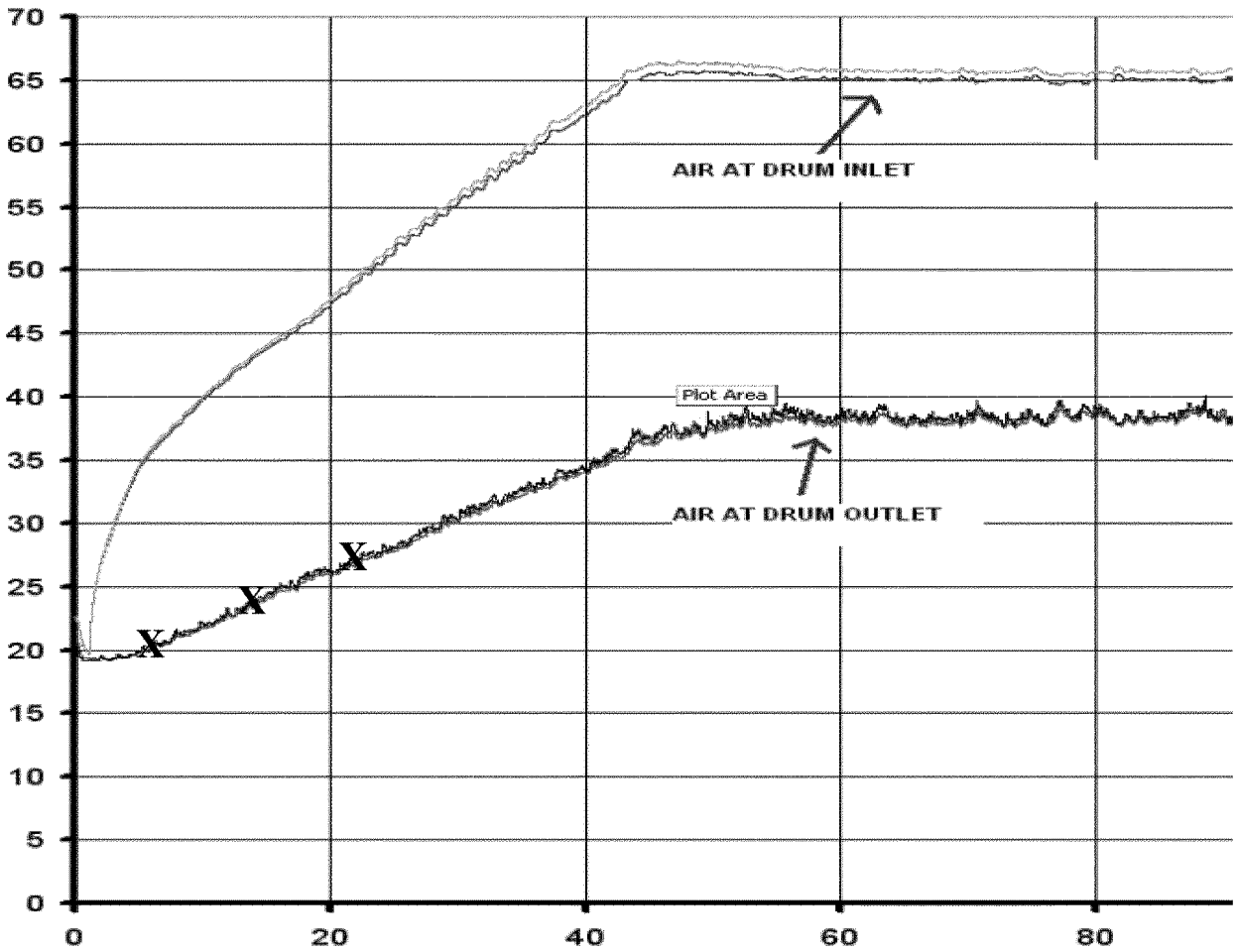
FIG. 3 shows the points in time where the sample measures of the temperature are taken according to a preferred embodiment of the present invention.
Figure 4:
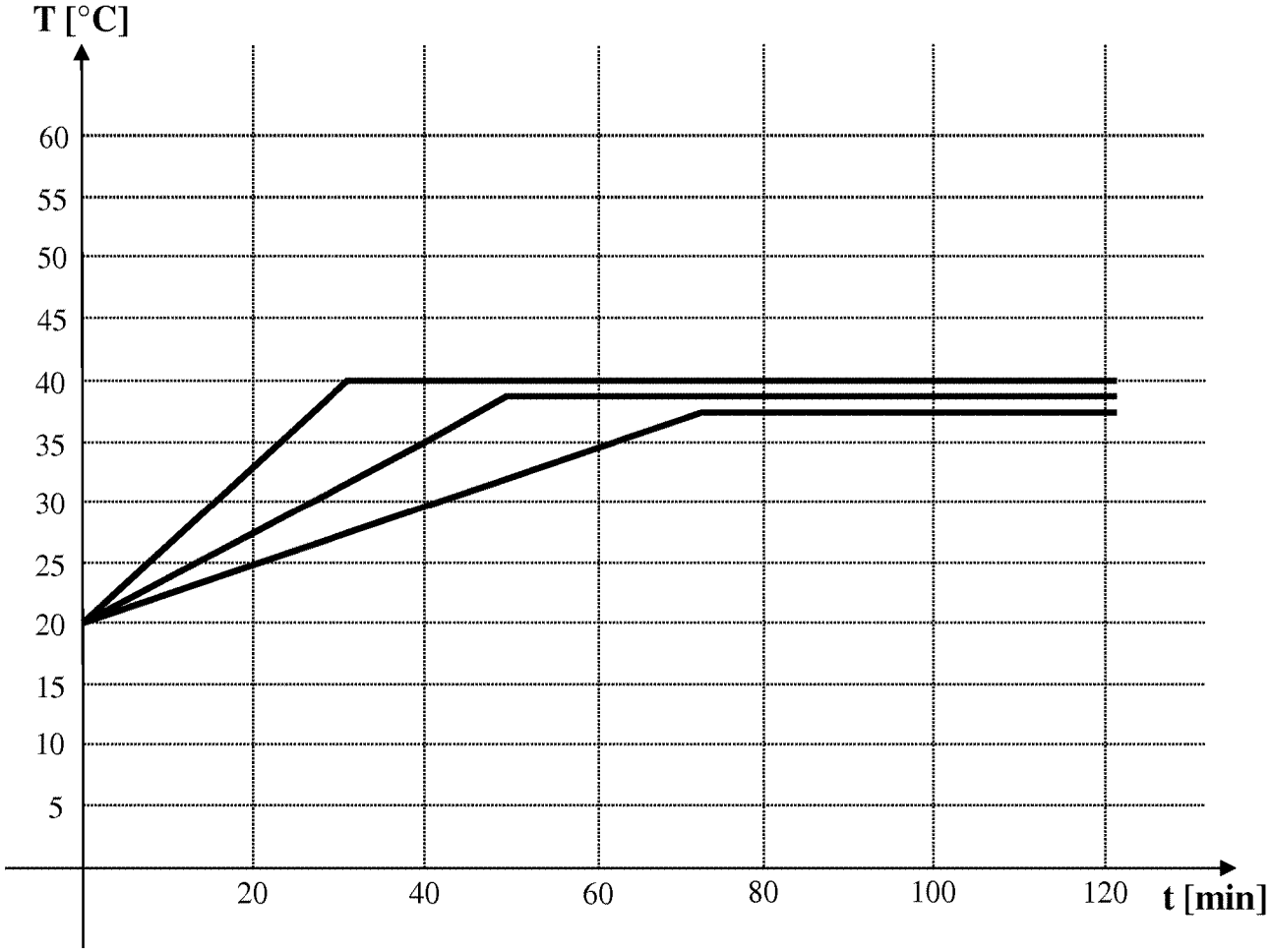
FIG. 4 shows an example of three reference curves according to different load and humidity values.

A possible solution is that of building a customized curve, using the real parameters of the specific drying cycle (or washing/drying cycle in case of a washing/drying machine) which can be used as a reference to compare the detected temperate. It can be noted that the shape of the curve of the outlet temperature is more or less always the same, it can just be "bigger" or "smaller" . So, as represented with "X" on the diagram shown in FIG. 3, e.g. three temperature samples during the first 20-30 minutes can be taken for the electronics to build (generate) the complete curve that can be used as the comparative reference to verify if a knot is present or not. The samples taken in the initial part of the process can be used to build the growing portion of the curve, while it can be assumed that after reaching standard working conditions the curve represents a substantially constant expected temperature. As a possible additional feature of the method of the present invention, a number of pre-set reference curves could be stored in the machine microprocessor memory according to most usual conditions of e.g. load and moisture. An example with three pre-set reference curves is shown in FIG. 4.

Figure 5:
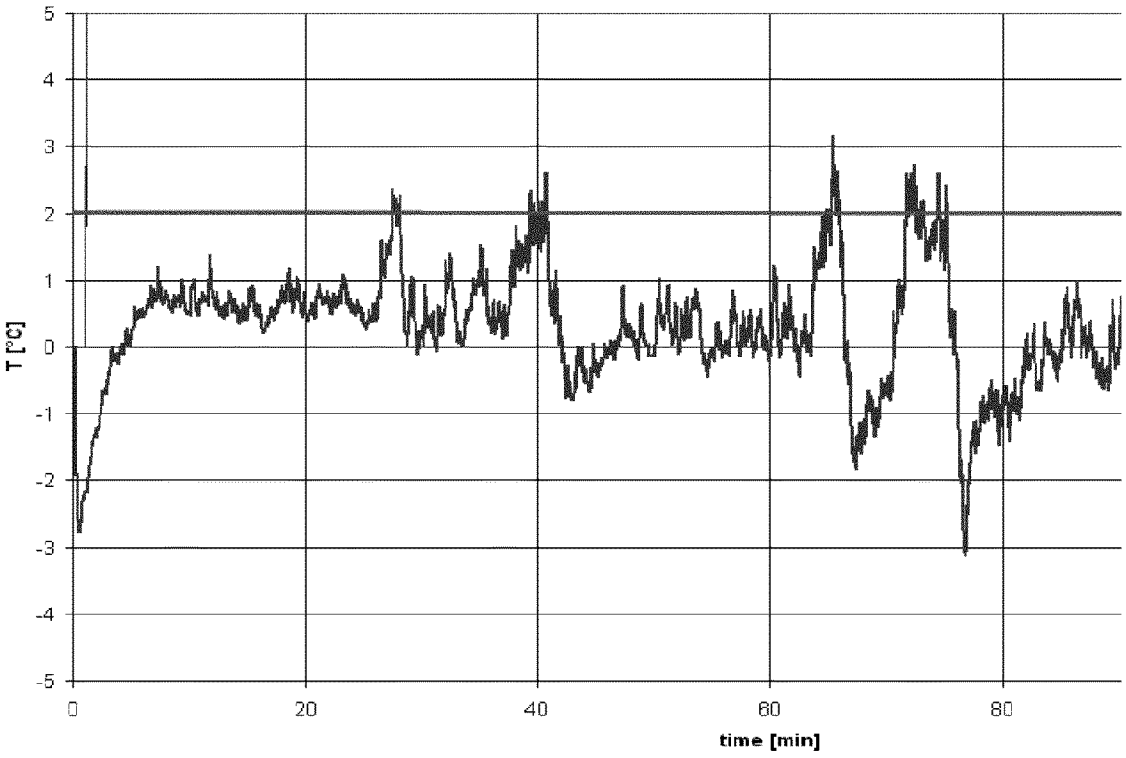
FIG. 5 represents a temperature curve in the presence of three knots when filtered by a well-tuned high-pass digital filter frequency range of the base temperature signal in the presence of a clothes knot.

An alternative solution requires the implementation of a high-pass numeric filter: as the frequency range of the base temperature signal is lower than the frequency range which characterizes the knot (i.e. the thermal inertia of the load is bigger than the thermal inertia introduced by the clothes knot), this filter has to cut all the frequencies but the frequency range which are specific of a clothes knot. FIG. 5 shows the result of the outlet temperature signal after passing through a general high-pass digital filter: if a fixed threshold is set at 2 (representing the difference in ° C. from expected temperature values) up to 4 knots are discovered, which is a very good result (a well tuned filter may provide even more precise results).

For example can be used the following:

$$T_{filtered\ low\text{-}pass}=a\ T_{filtered\ low\text{-}pass}+(1-a)T_iT_i \quad \text{current value not filtered}$$

$$T_{filtered\ high\text{-}pass}=T_i-T_{filtered\ low\text{-}pass} \quad \text{high pass filter}$$

Second order filter and/or appropriate value of constant a can offer better results. Such digital filter can be implemented in several ways including hardware, software and firmware implementations.

Another possible alternative solution for detecting anomalies in the temperature of the air being expelled by the drum, indicative of the temperature of clothes items in the drum, is that of analysing the gradient of the temperature curve in terms of derivate function. A sudden change in the gradient could be an indication of an unusual behaviour. According to an embodiment of the present invention, such analysis is done by estimating the derivative of the temperature curve. More in details, after an initial period (of e.g. 4-5 minutes) during which the temperature curve reaches a stable behaviour, a few values (e.g. 2 values) are detected at regular time intervals $t_c$ (e.g. 1 minute) in order to calculate the gradient of the temperature curve. According to a preferred embodiment of the present invention the gradient is calculated in the following way:

$$.P_{T_i} := \frac{T_i - T_{i-1}}{t_C}$$

A more accurate estimate of the gradient could be made by using 4 detected values and applying the following formula:

$$.P_{T_i} := \frac{T_{i-4} - 8 \cdot T_{i-3} + 8 \cdot T_{i-1} - T_i}{12 \cdot t_C}$$

Each calculated gradient value is then compared with the successive value. If the difference between the two exceeds a predetermined threshold (e.g. 50%) we can determine the presence of an anomaly. Alternatively it is possible to calculate the average of gradient values (or even filtering the values with a low-pass filter) over a period and then using such average as a reference value, so that the noise induced by the derivate function can be smoothed. It should also be considered that during the more stable part of the drying cycle (i.e. where the curve is more "flat") any anomaly in the gradient is more easily detected.

Figure 6:
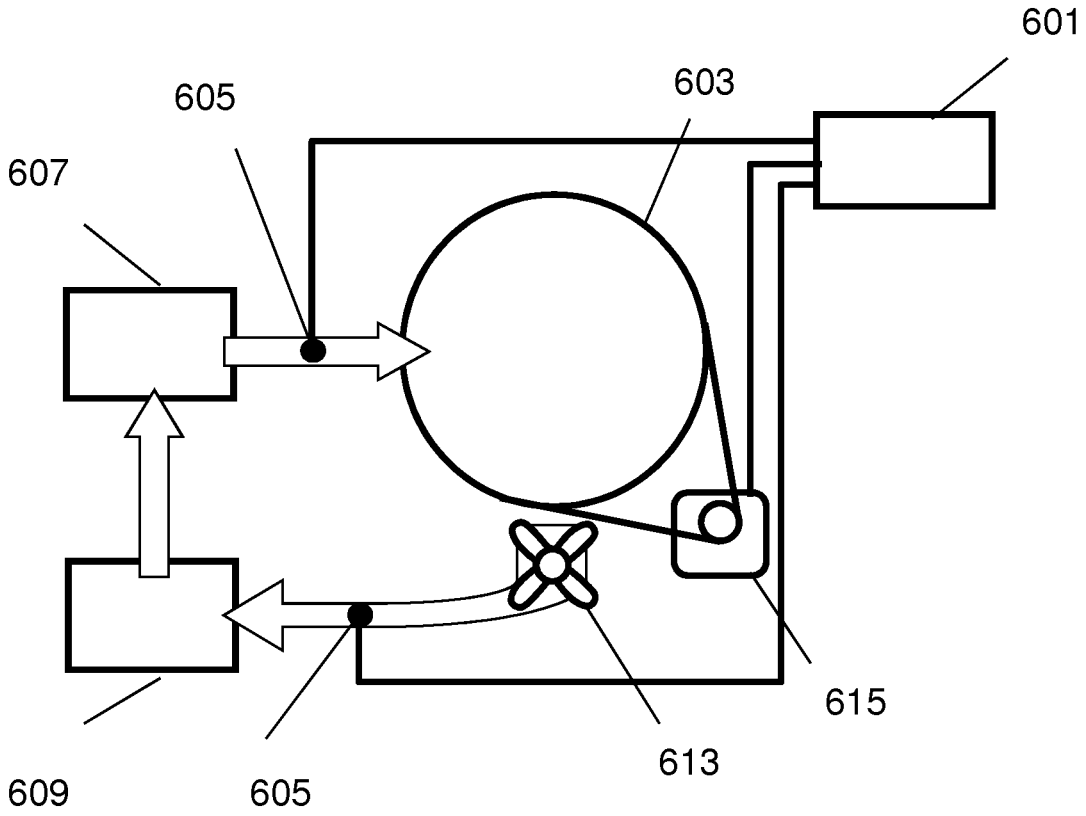
FIG. 6 is a schematic diagram of a system implementing the method according to a preferred embodiment of the present invention.

FIG. 6 shows a drying machine (e.g. a Tumble Dryer or a washing machine with drying functionality) which could implement the method and system of the present invention. The machine shown in FIG. 6 is a Tumble Dryer of the condense type. A microprocessor 601 (e.g.Freescale or ST (8 bit)) controls the operations of the machine. A software or a firmware loaded on the microprocessor memory can be customized to determine how the machine works. In the method and system according to a preferred embodiment of the present invention the drying machine (e.g. Tumble Dryer) includes a rotating drum 603 which is rotated by a motor 615 through a belt. The motor is controlled by the microprocessor 601 so that the rotation speed and the rotation directed can be varied to implement the untangling operations. A fan 613 causes the circulation of air through the drum 603: the air is also processed by a heater 607 which heats the air before it enters the drum and an air to air condenser which dries the air after it comes out of the drum. The dried air is then provided to the heater and the cycle continues. The machine has also a plurality of sensors 605 which detect the temperature in order to make an estimate of the temperature of drying air exiting the drum: they can be placed inside the drum 603 or (as it is the case shown in FIG. 4) at the inlet and/or outlet of the air. An alternative embodiment is a tumble dryer of the heat pump type: in such case the heater 607 would be replaced by a condenser, while the condenser 609 would be replaced by an evaporator. As explained above, the method of the present invention exploits the relationship between the clothes temperature (or better the curve of the temperature over time) and the likelihood of the presence of clothes knot in the rotating drum.

Figure 7:
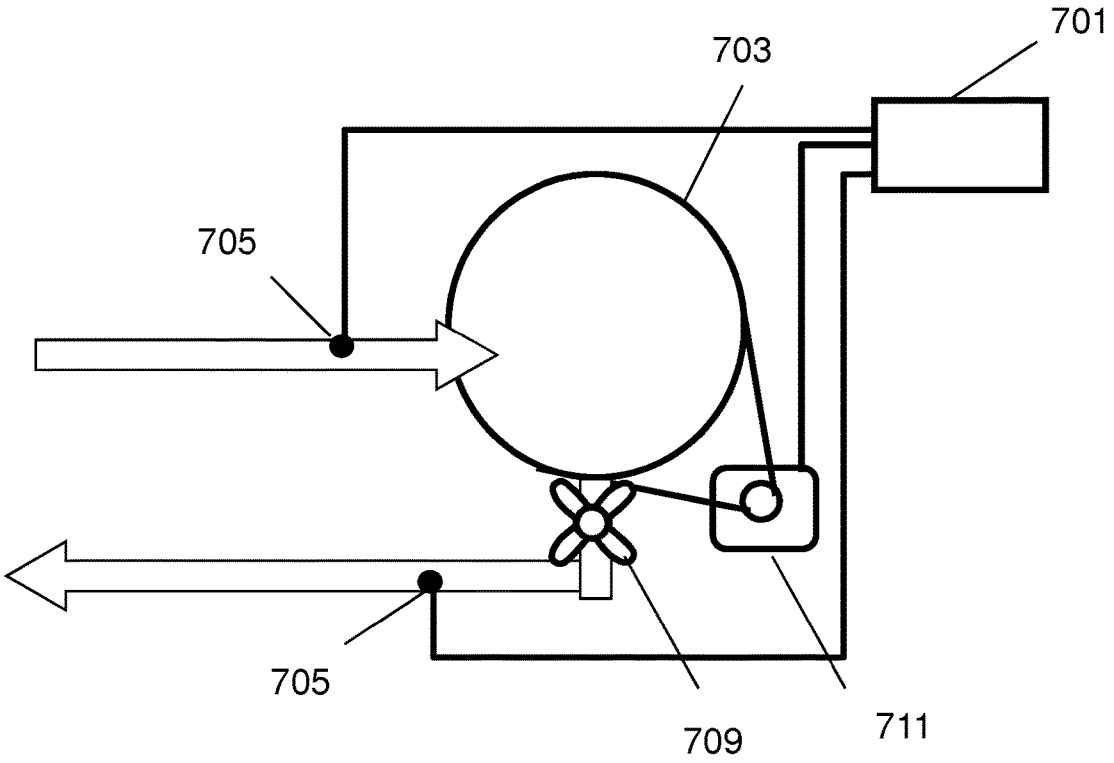
FIG. 7 is a schematic diagram of an alternative system implementing the method according to a preferred embodiment of the present invention.

In FIG. 7 another possible machine suitable for implementing the method and system of the present invention is shown. It is a simpler machine, a vented Tumble Dryer where the air is conveyed within the drum and expelled by means of a fan 709. Microprocessor with memory 701, drum 703 rotatable by a motor 711 and sensors 705 for detecting the temperature are similar to corresponding elements described in FIG. 6.

Figure 8:
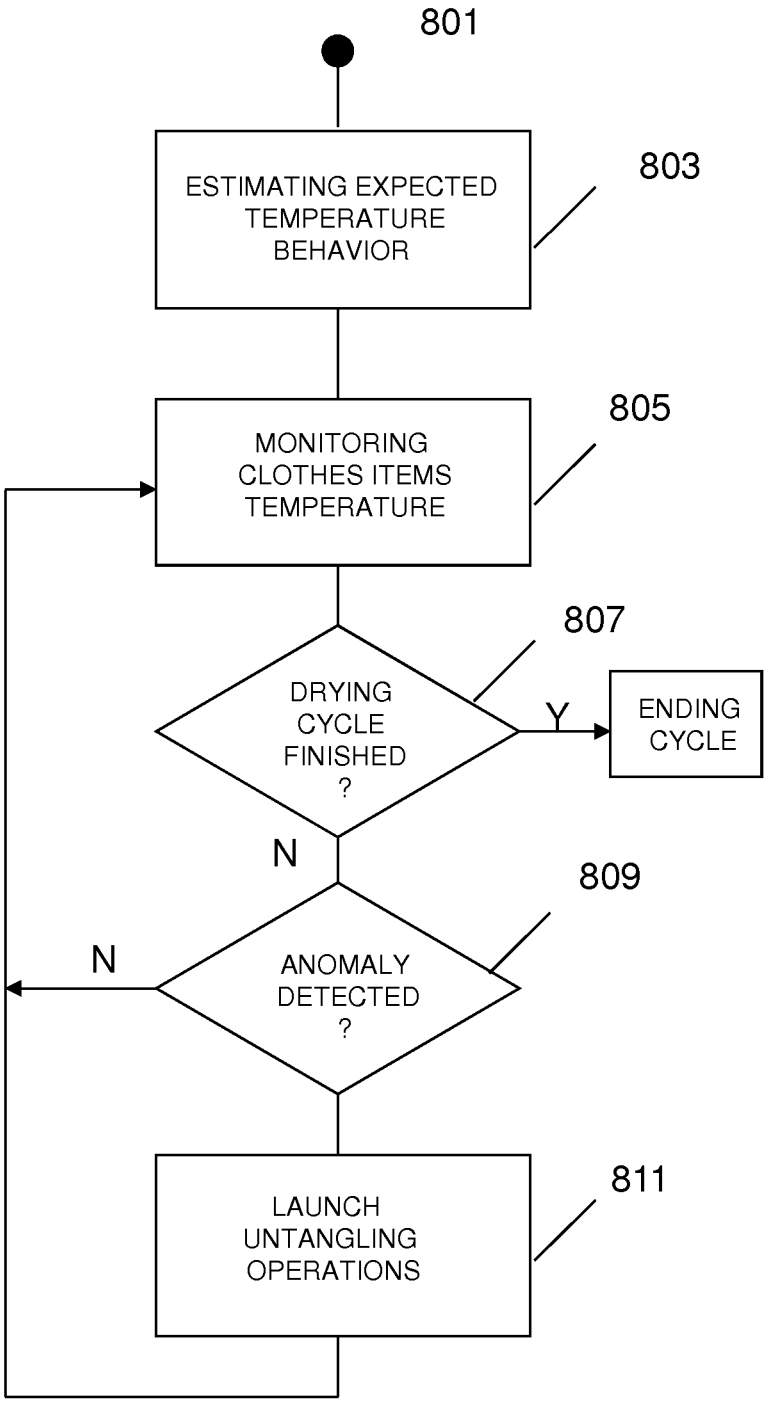
FIG. 8 is a diagram of the method steps of a preferred embodiment of the present disclosure.

FIG. 8 schematically shows a diagram representing the method steps of a preferred embodiment of the present disclosure. The process is a method for detecting the formation of clothes knots during a drying cycle in a drying or washing/drying machine. The process starts at circle 801 and it is transferred to box 803 where an expected temperature over time is estimated. This step could be skipped in case the machine has one or more predetermined sets of values stored in an internal memory. The process is then passed to step 805 where the temperature of clothes items inside the drum of the drying (or washing/drying) machine is monitored. As mentioned above this can be done by means of sensors able to detect the temperature of the drying air, the sensors can be placed inside the drum and/or at the outlet of the drum and/or downstream of the outlet of the drum (considering the direction of the drying air). When an anomaly in the expected temperature is detected (step 809) an untangling operation is started (step 811). As mentioned above, the way of determining an anomaly can be implemented in several different ways, from a simple threshold comparison to a more sophisticated analysis of the detected temperature curve with expected values. The monitored temperature could be the temperature measured directly inside the drum or the temperature of the expelled air or even the difference between the air temperature entering the drum and coming out of the drum. Also the untangling operation can be implemented in several different manners: e.g. stopping the rotation of the drum and rotating in a reverse direction, possibly repeated a few times, before restarting in the usual direction. In other embodiment the untangling operation could include a simple modification in the speed of rotation of the drum (e.g. increasing or decreasing the rotation speed). However those skilled in the art will easily appreciate that any alternative untangling method can be used instead. Also the duration of the untangling operations can vary and it is even possible to terminate such untangling operations before the set time, in case it is determined that the detected temperature is returned within expected limits. The process then goes back to step 505 and starts over again, until the end (807) of the drying (or washing/drying) cycle is reached. This determination of end of cycle can be done in several different ways, e.g. when a predetermined drying time has expired, but it can be more sophisticated, taking into consideration e.g. the temperature or a dryness parameter of the clothes.

The applicant has found that at the end of the untangling operation instead of resuming the predetermined drum movements associated to the drying cycle that was running before starting the untangling operation, it can be expedient to operating the drum so as to perform drum movements over time different from the predetermined drum movements associated to the drying cycle that was running before starting the untangling operation. In fact tests have shown that the probability that another need for an untangling operation is reduced. For this reason it is preferably to reduce the number of reversions of drum rotation and/or the time interval in which the drum rotates in reversed rotation direction in order to maximize the efficiency of the drying process. Further it is possible to increase and/or decrease the drum rotation speed depending on the cycle selected by the user and/or the type of fabric. It will be appreciated that alterations and modifications may be made to the above without departing from the scope of the disclosure. Naturally, in order to satisfy local and specific requirements, a person skilled in the art may apply to the solution described above many modifications and alterations. Particularly, although the present disclosure has been described with a certain degree of particularity with reference to preferred embodiment(s) thereof, it should be understood that various omissions, substitutions and changes in the form and details as well as other embodiments are possible; moreover, it is expressly intended that specific elements and/or method steps described in connection with any disclosed embodiment of the disclosure may be incorporated in any other embodiment as a general matter of design choice.

For example, similar considerations apply if the components (e.g. computers) have different structure or include equivalent units; in any case, it is possible to replace the computers with any code execution entity (such as a PDA, a mobile phone, and the like).

Similar considerations apply if the program (which may be used to implement each embodiment of the disclosure) is structured in a different way, or if additional modules or functions are provided; likewise, the memory structures may be of other types, or may be replaced with equivalent entities (not necessarily consisting of physical storage media). Moreover, the proposed solution lends itself to be implemented with an equivalent method (having similar or additional steps, even in a different order). In any case, the program may take any form suitable to be used by or in connection with any data processing system, such as external or resident software, firmware, or microcode (either in object code or in source code). Moreover, the program may be provided on any computer-usable medium; the medium can be any element suitable to contain, store, communicate, propagate, or transfer the program. Examples of such medium are fixed disks (where the program can be preloaded), removable disks, tapes, cards, wires, fibres, wireless connections, networks, broadcast waves, and the like; for example, the medium may be of the electronic, magnetic, optical, electromagnetic, infrared, or semiconductor type.

In any case, the solution according to the present disclosure lends itself to be carried out with a hardware structure (for example, integrated in a chip of semiconductor material), or with a combination of software and hardware.

The invention claimed is:

1. A method for operating a laundry dryer having a rotatable drum for accommodating clothes to be dried and an apparatus for circulating drying air through the drum, the method comprising the steps of:

performing a drying cycle selected by a user, wherein the drying cycle comprises predetermined drum movements over time depending on the cycle selected, detecting values indicative of the temperature of the drying air exiting the drum, monitoring the detected values;

building a curve with the detected values of temperature over time, filtering the curve with a high-pass numeric filter that cuts out all frequencies lower than a maximum frequency value indicative of an expected frequency range of a base temperature signal of drying air exiting the drum without clothes tangling conditions, responsive to an anomaly of the detected values with respect to at least one reference parameter including the maximum expected frequency value, determining that the clothes inside the drum are in tangling conditions, and starting an untangling operation for untangling the clothes inside the drum, wherein the untangling operation comprises a modification of the predetermined drum movements and the modification comprises at least one of the following:

stopping the rotation of the drum, reversing the rotation of the drum, and modifying the speed of rotation of the drum, and at the end of the untangling operation, either resuming the predetermined drum movements associated with the drying cycle that was running before starting the untangling operation, or performing drum movements over time different from the predetermined drum movements associated with the drying cycle that was running before starting the untangling operation.

2. The method of claim 1, wherein clothes tangling conditions are determined when the detected values exceed a predetermined threshold.

3. The method of claim 1, wherein the step of determining that the clothes inside the drum are in tangling conditions comprises maintaining in a memory a reference parameter indicative of an expected behavior of temperature of the drying air exiting the drum over time during the drying cycle.

4. The method of claim 1, wherein an expected temperature over time is adjusted according to values detected during the drying cycle.

5. The method of claim 4, wherein the step of adjusting the expected temperature is performed at the beginning of the drying cycle, before the step of monitoring the detected values.

6. The method of claim 1, further comprising the step of:

responsive to the anomaly of the detected values no longer showing any clothes tangling conditions, suspending the untangling operation and resuming the predetermined drum movements associated with the drying cycle that was running before starting the untangling operation.

7. The method of claim 1 wherein said step of detecting values is performed using a sensor of the laundry dryer to detect the temperature of the air at or downstream of the outlet of the drum.

8. The method of claim 1 wherein at the end of the untangling operation, drum movements over time different from the predetermined drum movements associated with the drying cycle that was running before starting the untangling operation are performed, and further including the step of reducing the number of reversions of drum rotation and/or the time interval in which the drum rotates in reversed rotation direction and/or increasing/decreasing the drum rotation speed.

9. The method of claim 1, wherein the steps of operating the laundry dryer are controlled by a microprocessor.

10. The method of claim 9 wherein:

at least one sensor is used for the step of detecting values indicative of temperatures during the drying cycle;

a microprocessor memory is used for storing the at least one reference parameter; and further comprising the steps of:

estimating a temperature of the clothes according to the detected values using the microprocessor; and starting the untangling operation if the anomaly of the detected values with respect to the at least one reference parameter is identified.

* * * * *